US012584306B2

(12) United States Patent
Bourne

(10) Patent No.: US 12,584,306 B2
(45) Date of Patent: Mar. 24, 2026

(54) ENERGY SAVING BATHROOM UNIT FOR SMALL SPACES

(71) Applicant: Seeley International Pty Ltd, Lonsdale (AU)

(72) Inventor: Richard Curtis Bourne, Davis, CA (US)

(73) Assignee: Seeley International Pty Ltd, Lonsdale (AU)

( * ) Notice: Subject to any disclaimer, the term of this patent is extended or adjusted under 35 U.S.C. 154(b) by 106 days.

(21) Appl. No.: 18/759,565

(22) Filed: Jun. 28, 2024

(65) Prior Publication Data

US 2024/0352724 A1 Oct. 24, 2024

Related U.S. Application Data

(63) Continuation-in-part of application No. 17/726,319, filed on Apr. 21, 2022, now abandoned.

(51) Int. Cl.
*E04B 1/348* (2006.01)
*E03D 5/00* (2006.01)

(52) U.S. Cl.
CPC ..... *E04B 1/34869* (2013.01); *E03D 5/003* (2013.01)

(58) Field of Classification Search
CPC ..... E03C 1/01; E03C 1/044; E04B 1/34869; E03D 5/003; F24D 17/00; F24D 17/02; F24D 2200/20; F28D 21/0012; F24H 4/04; F28G 3/166
USPC ... 4/661, 663–665, 638, 597, 553, 552, 546; 62/238.7
See application file for complete search history.

(56) References Cited

U.S. PATENT DOCUMENTS

| | | | | |
|---|---|---|---|---|
| 2,267,618 | A * | 12/1941 | Shapiro | E03C 1/01 4/663 |
| 2,575,325 | A | 11/1951 | Russell et al. | |
| 3,065,473 | A | 11/1962 | Sporck | |
| 3,594,825 | A * | 7/1971 | Reid | B61D 35/00 4/663 |
| 3,986,345 | A | 10/1976 | Pilz et al. | |
| 4,207,752 | A | 6/1980 | Schwarz | |
| 4,304,292 | A | 12/1981 | Cardone et al. | |
| 4,398,308 | A | 8/1983 | Berg | |
| 5,233,970 | A | 8/1993 | Harris | |
| 7,316,267 | B2 | 1/2008 | Kunimoto et al. | |
| 7,947,164 | B2 | 5/2011 | Hoffjann et al. | |
| 8,893,319 | B2 | 11/2014 | Gilbert | |
| 9,879,406 | B2 | 1/2018 | DeGaray | |
| 10,006,645 | B1 | 6/2018 | Howard | |
| 11,334,612 | B2 | 5/2022 | Kota et al. | |
| 11,414,847 | B2 | 8/2022 | Junge | |
| 2010/0017952 | A1 | 1/2010 | Thweatt, Jr. | |

(Continued)

*Primary Examiner* — Tuan N Nguyen
(74) *Attorney, Agent, or Firm* — Koenig IP Works, PLLC; Katherine Koenig

(57) ABSTRACT

A modular bathroom unit that includes a tub or shower with an abutting sink and toilet. The unit is energy saving by use of an integrated heat pump that captures heat from bath water and after heat removal uses the water for toilet flushing. Removed heat from the heat pump circuit may be used for hand washing. The unit features two or three linear sides that allow placement in closet-like spaces found in residential construction. To save space, the tub may be shaped with a narrow end for feet and a wider end for a human torso. Either the toilet or the sink may abut the narrow end of the tub.

8 Claims, 7 Drawing Sheets

(56) References Cited

U.S. PATENT DOCUMENTS

| | | | |
|---|---|---|---|
| 2011/0024080 | A1 | 2/2011 | Bose et al. |
| 2011/0203786 | A1 | 8/2011 | Darnell et al. |
| 2014/0238063 | A1 | 8/2014 | Brucoli |
| 2021/0207848 | A1 | 7/2021 | Xu et al. |
| 2022/0074604 | A1 | 3/2022 | Deivasignamani et al. |

* cited by examiner

ENERGY SAVING BATHROOM UNIT FOR SMALL SPACES

CROSS-REFERENCE TO RELATED APPLICATION

This application is a continuation-in-part of U.S. patent application, Ser. No. 17/726,319 filed Apr. 21, 2022, which in turn claims priority under 35 U.S.C. 119(e) from U.S. provisional application No. 63/258,508, filed May 10, 2021.

TECHNICAL FIELD

The invention relates to residential construction featuring an integrated tub or shower, sink and toilet, with heat capture from water used in human bathing.

BACKGROUND ART

Most water heaters in U.S. residences are fueled by natural gas, although electric water heaters have also been widely used where residential electric rates are low. For greener, all-electric buildings, central air-source heat pump water heaters (HPWHs), as direct replacements of conventional gas or electric water heaters, are viewed as the mainstream technology. Heat pumps are more efficient than direct resistance electric heating devices because they use a vapor-compression process to extract some of the required heat from an available air source; usually a garage, a basement, or an outdoor closet. HPWHs operate at net efficiencies 50% to 200% higher compared to resistance electric water heaters, but they cool their adjacent vicinity, which is not typically desirable in fall, winter, and spring.

After use in tubs, showers, and bathroom sinks, heat in warmed water is wasted down the drain. The prior art has recognized that this warm water can be used as a source for a heat pump cycle where the system evaporator extracts heat from the drain water and the condenser heats water stored for washing use. For example, see U.S. Patent Publication 2011/0203786 to Darnell et al. that teaches that waste water heat from a bathtub or sink can be actively transferred to incoming potable water for heating the potable water. Waste water from kitchens and washing machines can also be used as the source to enhance heat pump efficiency, but such water often contains enough residue that filtration is required.

Other than bathtubs and showers, most domestic water heating outlets experience intermittent bursts: a quick hand-washing, on/off kitchen sink draws, or multiple short flows in dishwashers and clothes washers. Only bathtubs and showers use continuous hot water draws of three minutes or longer. Draw patterns vary considerably by household.

U.S. Pat. No. 9,879,406 to D. A. DeGaray Arellano shows a shower that collects water in a basin for pumping to a toilet to be used for flushing.

U.S. Pat. No. 4,207,752 to Schwarz shows a single device that accepts a waste water stream into a drain basin, uses a heat pump cycle to extract heat from that basin, stores hot water in an integral pressurized tank, and discharges the basin water when the heat extraction cycle is completed.

In residential construction of small homes a bathroom of reduced size and cost becomes desirable. An object of the invention is to provide a modular, integrated tub or shower, sink and toilet unit for residential construction, that increases home energy efficiency using a heat pump cycle to recover heat from bathroom waste water.

SUMMARY OF DISCLOSURE

The above object has been satisfied with an energy saving modular bathroom unit featuring an integrated tub or shower, sink and toilet where the tub or shower has outwardly facing linear sides joined at extremities for placement against walls of a residential structure. Energy is saved in the unit with heat recovery from the tub or shower using a heat pump circuit whose evaporator extracts heat from drain water captured in a water catch basin located immediately below, and integrated with, the tub or shower. The heat pump circuit also includes a compressor, an expansion device, and a condenser associated with an insulated and pressurized hot water tank. The sink and toilet abut the tub or shower in a compact geometrical arrangement with the toilet receiving flush water from an atmospheric tank filled with waste water pumped from the catch basin. The outwardly facing linear sides of the unit snugly fit against walls in residential construction.

DETAILED DESCRIPTION

Figure 1:
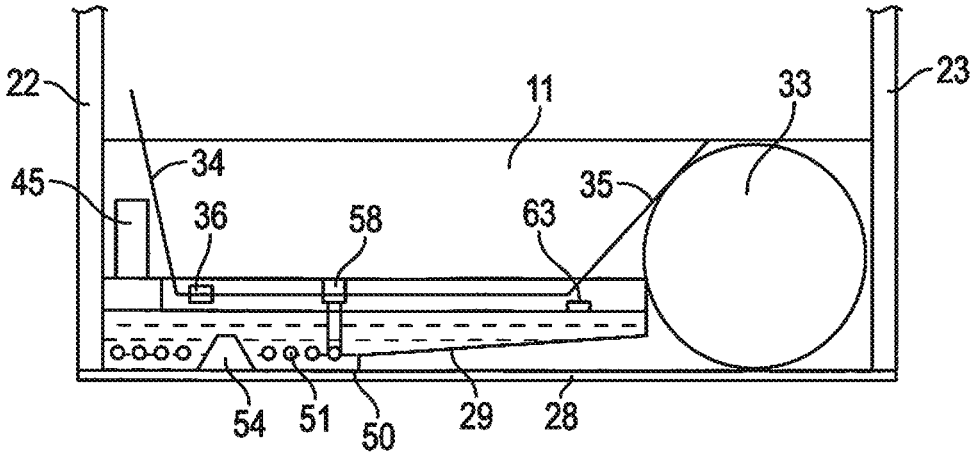
FIG. 1 is a vertical sectional view of an energy recovery unit used in the bathroom unit of the invention.
Figure 3:
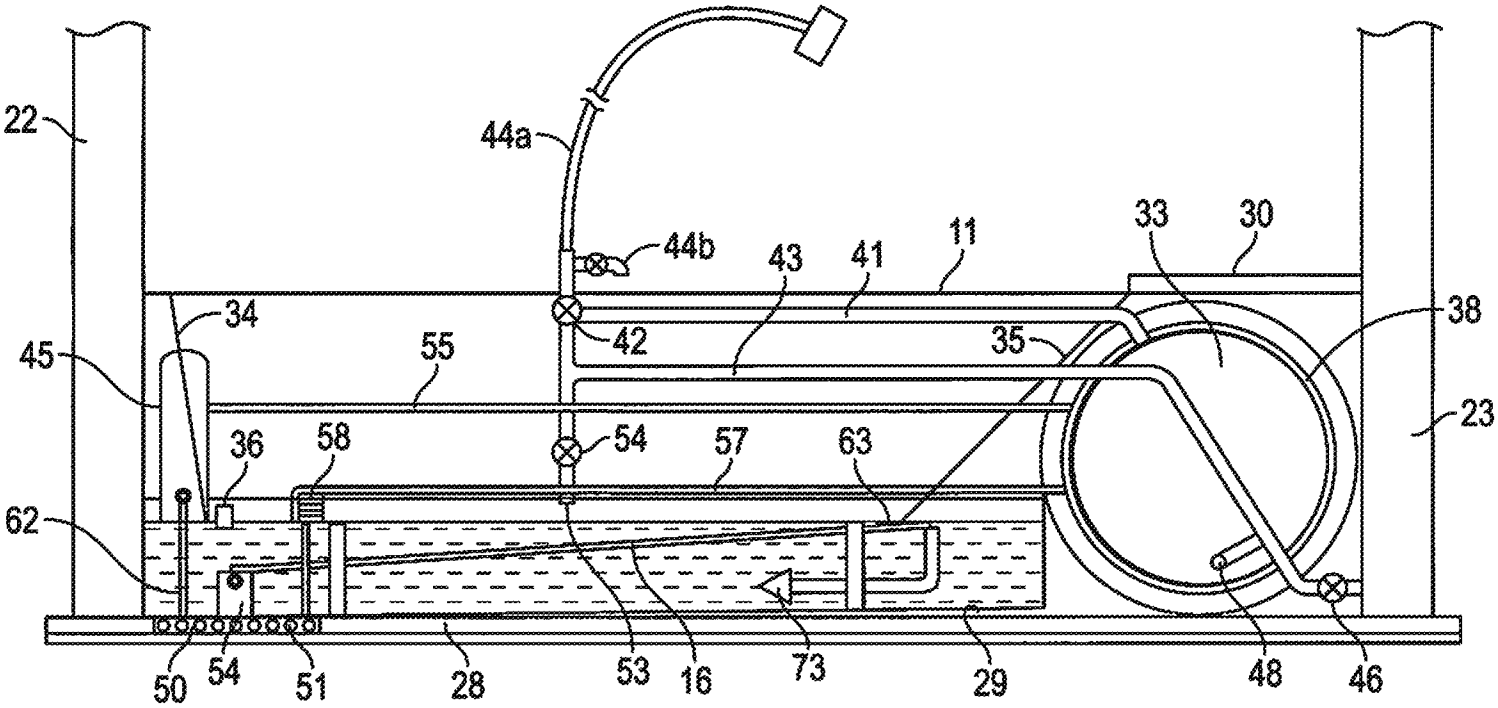
FIG. 3 is a detailed view of the apparatus of FIG. 1.

FIG. 1 and FIG. 3 show similar sectional views, with FIG. 1 intended to introduce basic components and FIG. 3 providing more detail. With reference to FIG. 1, a standard bathtub 11, with a sloping drain wall 34 and a less sloping back wall end 35, is installed between framed walls 22 and 23 and above a drain or catch basin 29. The framed walls 22 and 23 can be room walls in residential construction in a space similar to a closet. The tub has at least two outwardly facing sides plus possibly a third linear side seen in FIGS. 4 and 7 that fit between room walls in residential construction. Returning to FIG. 1, tub 11 does not drain bath water into a sewer but to the drain basin 29 via tub drain 36. The basin temporarily holds hot water from the tub for heat removal. Next to wall 23 is a horizontal axis, cylindrical, pressurized and insulated hot water tank 33 with potable water therein. Tub drain 36 allows water used in bathing to flow by gravity into the drain or catch basin 29 that acts like a large pan for hot water capture and heat removal. A standard 5' long tub uses a 6' long space to provide room for the horizontal-axis cylindrical hot water tank 33 in contact with the sloping tub end wall 35. The pre-assembled system may arrive at the job site on a strong plywood bottom sheet 28 as a pre-fabricated human bathing unit that becomes part of the subfloor if on framed construction, or rests atop concrete in "slab-on-grade" construction. Between the tub bottom and the bottom sheet 28 is the catch or drain basin 29 that collects drainage water from the tub 11 and possibly from a nearby lavatory sink, not shown. The basin 29 slopes from the "reclining end" 35 of the tub 11 toward the drain end 34. The system may include support legs that convey tub occupant loads downward from the tub floor to the sloping basin, with shims aligned under the legs that support the basin and tub on bottom sheet 28.

An electrically driven heat pump removes heat from hot water in the drain basin 29. A vapor compression refrigeration cycle is used for heat transfer in a heat pump. A major component of the heat pump is the compressor 45 shown here as mounted between the tub drain wall 34 and framed wall 22. Hot refrigerant gas from compressor 45 is transmitted to the hot tank 33 where heat is removed using a helical coil wrapped around the tank as shown in FIG. 2.

Figure 2:
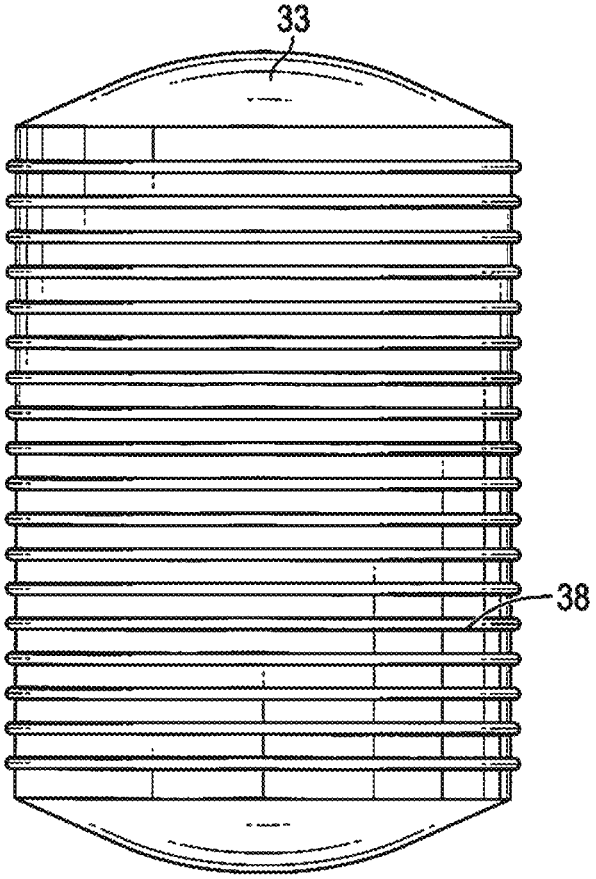
FIG. 2 is a side view of a pressurized tank used in the apparatus of FIG. 1.

In FIG. 2 the pressurized hot tank 33, shown with a vertical axis, is seen to have a helical coil 38 wrapped around the tank for good heat transfer that warms water in the tank when the compressor 45 is operating. The coil can be 5/16" tubing at ½" spacing on a 27" long tank that is 17" in diameter. The helical coil acts as a heat pump condenser heat exchanger that heats the tank 33 when the compressor 45 is operating. The tank is made of stainless steel to avoid corrosion and any need for future replacement. In the preferred embodiment shown, the tank contains 26 gallons of water. With 1.5" urethane foam insulation all around, the wrapped tank dimensions are 20" diameter and 30" long, to fit in the space shown.

In an alternate embodiment, the pressurized hot tank 33 may have an internal helical coil heat exchanger instead of the exterior wrapped helical coil 38 shown in FIG. 2. An internal coil can provide relatively greater heat transfer surface area, but is more expensive than a wrapped external coil, because of both manufacturing challenges and plumbing codes that require double wall separation between refrigerants and potable water. This requirement complicates the design of internal tank domestic water heat exchangers.

In a further alternate embodiment, an atmospheric pressure hot tank, not necessarily cylindrical, may be used that includes a condenser heat exchanger to transfer heat from the refrigerant to the tank water, and a load-side, immersed, pressurized heat exchanger that heats domestic water from the hot tank water.

Returning to FIG. 1, cooled gas in the helical coil condenses to a liquid and is then forced through an expansion device 58, such as a capillary tube, seen in FIG. 3, such that the liquid refrigerant flashes to a gas when entering an evaporator twin spiral heat exchanger 51 that surrounds the pump 54 in a sump 50 that is in a recessed region of the drain basin 29 below the tub drain 36. A sensor, such as a conductive switch, tells the pump to turn on when water is in the sump, and off when the sump is empty. Lukewarm gas leaves the evaporator through a gas line to re-enter the compressor 45 and continue the refrigerant flow cycle. After compressor operation has cooled water in the drain basin, the pump 54 discharges the cooled water into the open-top drain pipe 63, which also serves as an overflow to assure that an over-filled basin cannot spill over onto the bath floor. The drain 63 can be an open-top vertical pipe of 1½" diameter through which water drains through an outlet pipe, not shown, to a tub trap that prevents sewer gas from entering the bathroom.

The drain basin 29 is configured to hold 20% more volume than the hot tank 33, based on calculations showing effective heat pump efficiency at that volume. In the embodiment shown, the 30" wide×54" long basin 29 with 5" high rim can contain 39 gallons of water. The basin is equipped with a glory hole overflow drain 63.

In the more detailed view of FIG. 3, a shower head and flexible supply hose 44*a* and tub fill spout 44*b* connect the tank outlet 41 through a control valve 42 that mixes hot tank water with cold water from a cold supply line 43 to achieve the desired delivery temperature. Water supplied to the control valve from the tank 33 is replaced by cold water that enters the tank through the bottom inlet 48 from the cold water supply line 46.

The compressor 45 can be located in the curved tub wall corner cavity at the tub drain end. A pipe 55 carries hot, pressurized refrigerant gas from the compressor 45 into the condenser heat exchanger 38 spiral wrapped on the hot tank. As the gas flows through the heat exchanger, it condenses and leaves the heat exchanger through a pipe 57 as a high-pressure liquid entering next an expansion device 58 before entering the flat spiral evaporator heat exchanger 51 which is located in a sunken reservoir or sump 50 integral with the drain basin 29. The spiral evaporator 51 extracts heat from the drained water when the compressor is operating. From the evaporator 51, lukewarm low pressure refrigerant returns to the compressor 45 through line 62.

Basin drainage and reservoir pump-out are important for system operation and maintainability. When wastewater in the drain pan has been sufficiently cooled, the pump 54 operates to discharge water through the line 16 into the overflow 63. Overflow line 73 is pumped to a toilet tank for flush water storage. The compressor is turned on by command from the controller when water that is warmer than a setpoint is present in the drain pan, and the pump is turned on when the water has been cooled to below the setpoint, as will be further described with reference to the controls table below. In an alternate embodiment, the system may include an automatic wash-down system that uses flat-spray 90-degree nozzles pointed inward at basin corners. A solenoid valve may be activated by the control system to operate the wash-down system after a fixed time period or a fixed number of cycles. Unheated water from the wash-down system can also be the source for startup, makeup, or post-vacation water heating. In these circumstances, without a basin wash-down system, it will be necessary to use either the heat pump cycle with cold water from the fill valve, or electric heat elements in the hot tank 33 to satisfy water heating needs.

A 12" wide ledge 30 covers the storage tank 33, acting as a seat and also providing additional space for showering in the tub. Where a 2-bath home might have back-to-back bathtubs, a single 20" diameter by 63" long tank and single, larger refrigeration system could serve both bathtubs. When the valve 42 is off, a solenoid valve 54 may be opened to add water through an opening 53 into the drain basin 29, as a water source for auxiliary heating during startup or after an idle period between wash cycles, when the hot tank may have cooled off.

Figure 4:
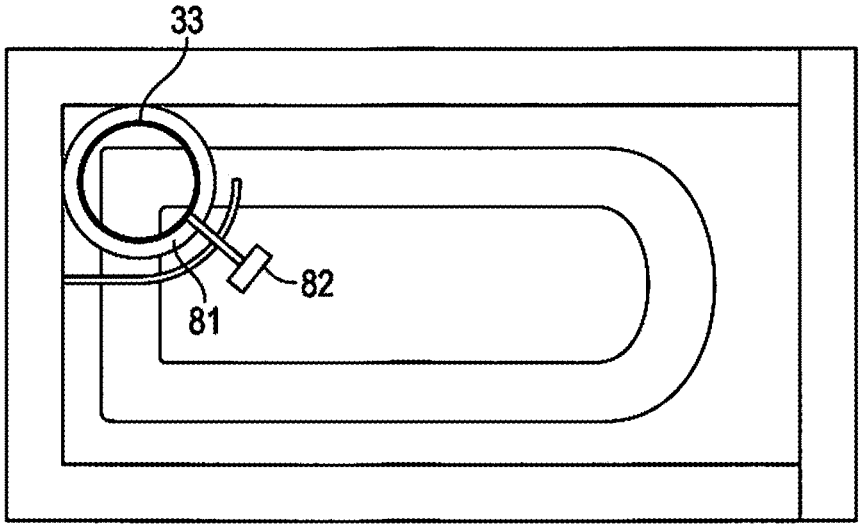
FIG. 4 is a plan view of an alternate energy recovery unit with the pressurized tank above the tub.

In FIG. 4 a second embodiment of the invention has a hot tank pre-packaged with flexible connecting lines for placement above the tub, similar to that shown in FIG. 1 except that it does not require floor area for the tank. Therefore, it is more appropriate for retrofit applications in replacement of an existing tub. The insulated hot water tank 33 is a vertical cylinder located above the tub. The tank 33 is connected by flexible lines, not shown, namely 2 refrigerant, 1 cold water, 1 sensor wire. In this version the single 25-gallon tank is 13.5" diameter by 42" long, pre-insulated with an attractive insulative cover 81 designed for structural fastening to the wall framing. The compressor is hidden in the tub corner under the tank, and the basin is now the full footprint of the tub. The shower head 82 is part of the insulated tank assembly, which for packing and shipping fits into the tub basin. In a third version, not shown, a similar tank, but larger diameter and shorter, fits near the ceiling, with horizontal tank axis, above the fill end of the tub. In both these cases, for storage and shipping, the flexible connecting tubes and wires may be pre-coiled in the tub basin around the tank. A vertical cosmetic cover can be provided for hiding these lines in the wall corner.

Figure 5:
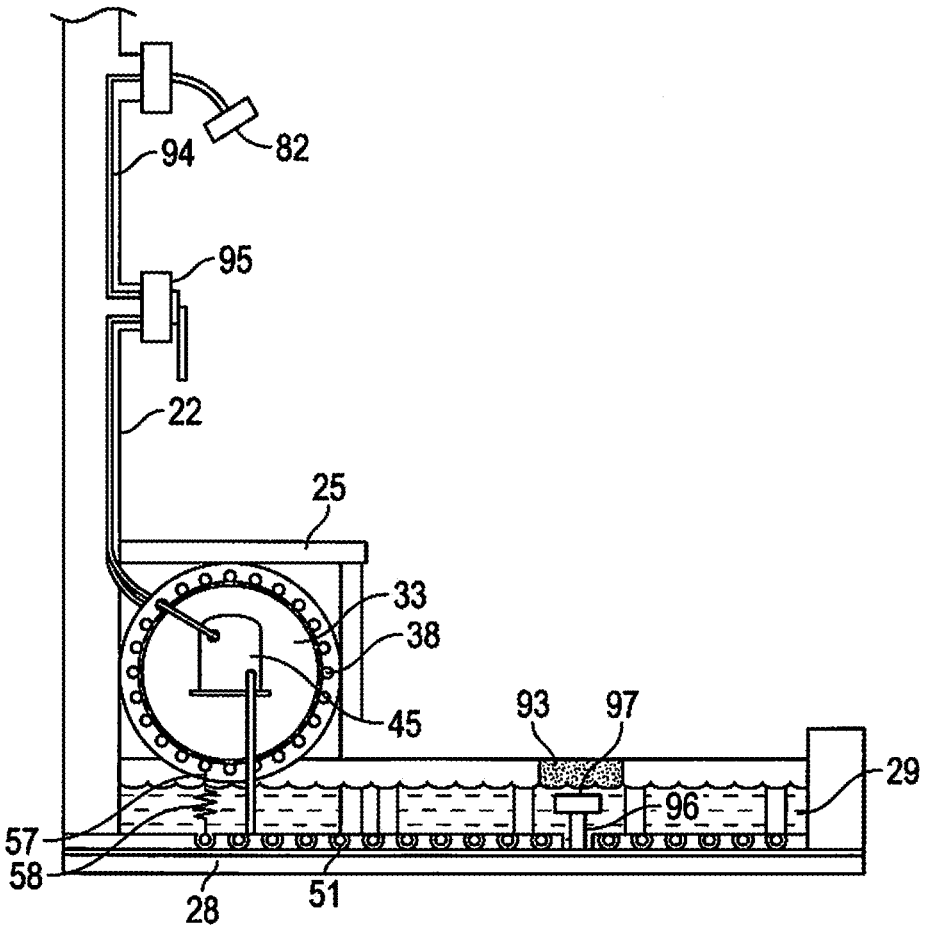
FIG. 5 is a vertical sectional view of a shower only energy recovery unit as an alternative to the apparatus of FIG. 1.

In FIG. 5 a vertical section view of a shower-only embodiment has a hot tank 33 integrated into a shower bench seat 25. The tank 33, condenser 38, and compressor 45 are located beneath a removable bench seat 25 and supported on the basin 29 which rests on the subfloor bottom sheet 28. Immersed in the basin water is the evaporator 51, which receives evaporating liquid refrigerant from the expansion device 58 through tubing 57 from the condenser 38. Again, a tube delivers hot refrigerant gas from the compressor 45 to the condenser 38. Flexible, pre-plumbed lines that are coiled for transport can be placed in the wall framing 22, delivering hot and cold water to the mixing control 95 and then upward to the showerhead 82 through the piping line 94. Used shower water drains through a screen 93 into the basin 29.

FIG. 5 shows an alternate mixing strategy with a lift valve rather than a pump. After heat extraction, a normally-closed lift valve 96 is opened on command from the controller, by an actuator 97. Drainage from both the overflow, not shown, and the lift valve flows into a P-trap, not shown below the subfloor 28. The trap prevents sewer gases from entering the basin and bathroom above.

Figure 6:
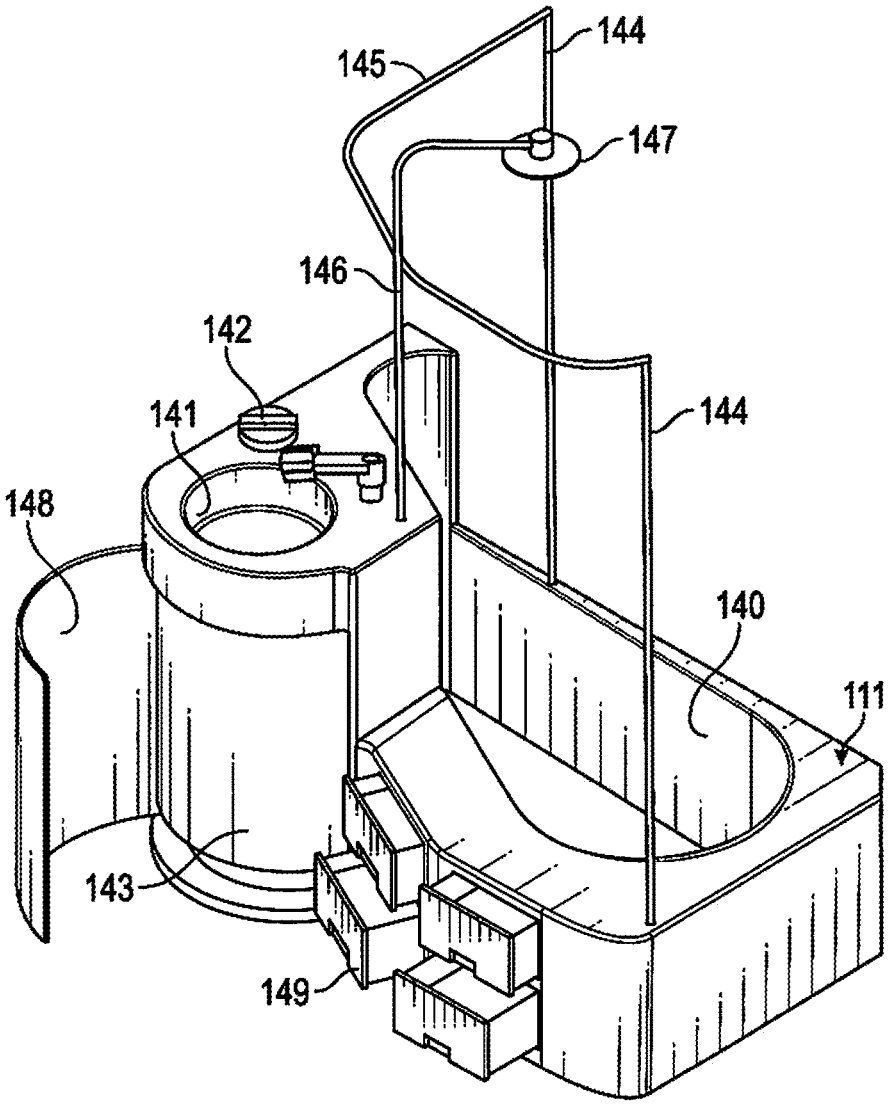
FIG. 6 is a perspective view of an integrated tub and sink for placement in small spaces.

FIG. 6 shows a more complete built-in appliance with a re-shaped tub and an integrated bathroom sink. Components common to all embodiments are not shown in FIG. 6, including all refrigeration components, the basin, the pump, and the overflow. The shaped tub 140 abuts basin 141. The tub is shaped for greater comfort and reduced water volume compared to standard tubs. The bather's torso fits in the widened, deeper end where the drain is, with the bather's feet at the narrow end. A further embodiment later shown in FIG. 9, includes a raised narrow end with higher, near-horizontal foot rest, for greater comfort and further reduced water volume. The narrow end is adjacent two linear sides of the unit. The wide end may also be adjacent to linear sides. The sink 141 allows the insulated hot tank 143 to be placed beneath it, accessed through a hinged panel 148. The controller 142 may allow selection of a bath or shower function, desired delivery temperature, drainage control and other user selectable items. This embodiment is designed to fit within a 30"×60" framed alcove. The sink 141 with its control features and water supply may be a separate element that for shipping and handling fits into the tub recess but has flexible lines all pre-connected to minimize field labor. This tight packing would allow the delivered package to fit (on edge) through doorways as narrow as 28". The sink drains into the under-tub basin, and its waste water also becomes a source for the water heating cycle. The tub has no connections to the basin below but is integrated therewith. Waste water from both the main drain and the overflow drain flows into the basin. FIG. 6 also shows other components that pack for delivery in the tub recess, including chrome vertical support pipes 144, the showerhead support pipe 146, the showerhead 147, and curtain support rod 145. The vertical elements slide into prepared sleeves in the base assembly, and the showerhead support pipe connects with "push-fit" connectors into the sink assembly. Also shown are pull-out drawers 149 that take advantage of available space.

Figure 7:
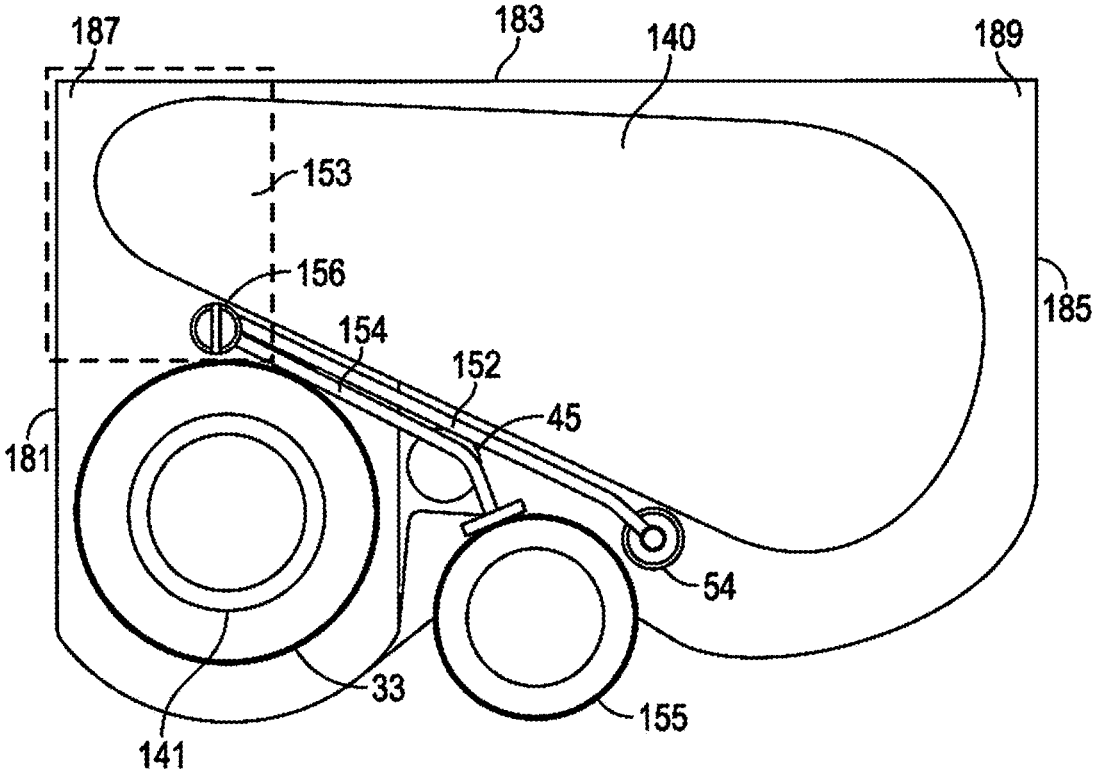
FIG. 7 is a top plan view of the energy saving unit of the invention that includes a tub, toilet and sink integrated into a unit for small spaces.

In the embodiment of FIG. 7, a low-profile toilet with an oversized tank, used to flush the toilet using post-heat extraction waste water, are included to complete a full bath fixture set. Note that the unit has three linear sides 181, 183 and 185 that allow placement of the unit as a bathroom module in residential construction. Extremities of sides 181 and 183 as well as sides 183 and 185 meet at right angles 187 and 189 respectively. Some added features are labelled, including the compressor 45 located at floor level between the hot tank 143 and the added toilet 155 which is abutting the wide end of tub 140. The pump 54 sends water from the sump, again a sunken section of the basin through a pipe 152 and an accessible filter 156 into an uninsulated, atmospheric toilet tank 153. This tank, approximately 15" wide by 21" long by 18" deep, sits entirely above the water level of the toilet bowl, contains more than 20 gallons of flush water, and has a removable lid, similar to typical toilet tanks except for its larger size and lightweight polymeric design. The top of the toilet tank 153 is above the sink 141. The toilet system, preferably using the 0.8 gallons per flush technology of the Niagara Stealth toilet, holds enough water for 25 flushes. When the tank 153 is full, it can overflow through the line 154 shared with the flush valve discharge into the toilet bowl 155, which then overflows through its integral P-trap, just as any toilet bowl would if it had a leaky fill valve. Note that the toilet tank 153 overhangs the narrow, shallow tub end, but does not interfere with bathing or shower space.

With this design, the toilet trap becomes the only trap needed for the entire bathroom, and it is integral with the appliance. For toilet operation when recent washes have not kept the tank 153 adequately full, there are two tank re-filling options. The least expensive option uses the vacation heating cycle that adds water to the under tub basin through a valve and basin inlet. The compressor can operate concurrently to heat the hot tank 33, since without recent sink and/or shower/tub use, the hot tank temperature might need boosting. The second tank refill option, not shown, would add a float valve in the tank 153, connected to the cold water supply, where the float valve maintains a minimum water level, adequate for one or 2 toilet flushes.

HPHWA operation is managed by the user and by a controller. User controls involves turning a mixing valve handle from cold to hot, flipping a toggle switch that opens a fill solenoid valve, and then adjusting the mixing valve to achieve a comfortable water temperature. At the end of each shower or tub-fill, the user switches the solenoid fill valve off and returns the mixing valve to its cold position. The controller is connected to temperature sensors in the tank and basin, respectively; and to two basin water level sensors, one lower and one upper. When the tank temperature sensor reading is below the controller setpoint and the lower water level sensor indicates that there is no water in the sump, the controller will either activate the tank heat elements, if present, or open the fill valve to add water to the basin and sump, depending on makeup heat strategy to achieve the desired hot tank storage temperature. When the tank sensor reading is below the setpoint and the lower water level sensor indicates that there is water in the sump, the compressor turns on to extract heat from water in the basin and transfers it to the tank, until the tank temperature plus a hysteresis buffer is achieved. When the basin temperature sensor reading falls below an upper setpoint, typically cooler than surrounding air, for example 55 degrees F., the controller will either turn on the pump or open the drain valve, depending on drainage design, until sump water temperature rises again to the upper setpoint. If the basin temperature sensor drops below a lower setpoint, for example 50 degrees F., the controller will disable the compressor until water temperature rises. In simple terms, the compressor operates when there is heat to be extracted from basin water, and the pump or drain operates when basin water has been cooled to a point that heat pump efficiency is reduced below a desired level. A water heating cycle ends when the last accessible cooled water batch is pumped or drained from the sump.

The upper water level sensor is a safety/overflow protection device that tells the controller to disable the fill solenoid valve and activate an alarm, since water at this high level in the basin indicates that the drainage mechanism has malfunctioned. An optional appliance control feature is a wireless network connection that allows an outside entity such as an electric utility or a regulatory body to control system-wide electrical loads. In this mode, waste water would remain in the basin until utility loads were reduced. This would reduce efficiency somewhat since water in the basin would cool during the wait.

Figure 8:
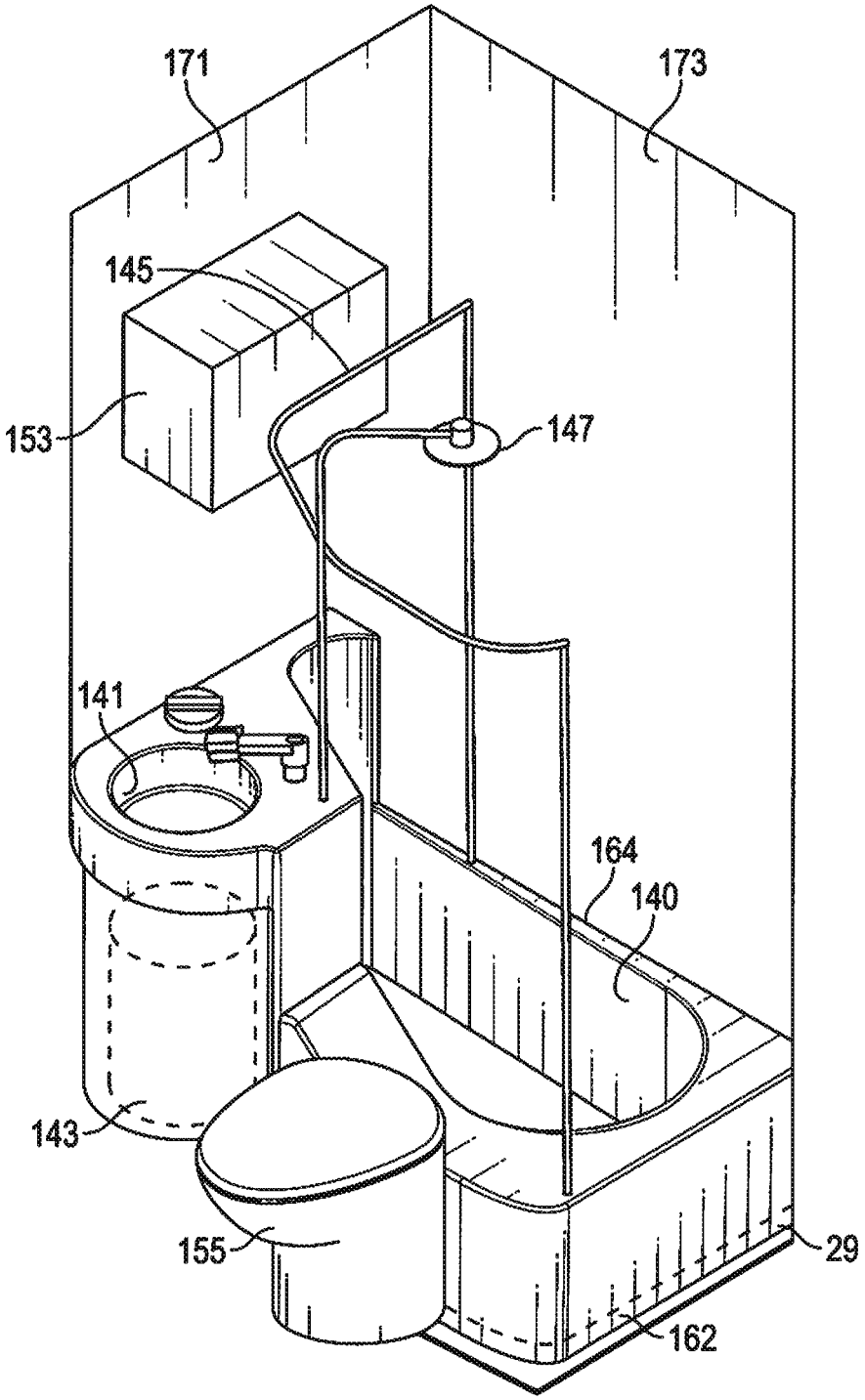
FIG. 8 is a perspective view of the apparatus of FIG. 7.

In FIG. 8 an energy saving bathroom unit is seen to have tub 140 and shower 147 overlying basin 29 that receives bathing water by gravitational flow. A heat pump circuit as explained in FIGS. 1-3 resides in the basin. Tub 140 is seen to have linear sides 162, 164 and another linear side parallel to side 162 and at the opposite end of tub 140. This opposite end may be placed against residential wall 171 while linear side 164 may be placed against residential wall 173. A first tank, namely hot tank 143, is for hot water storage by use in tub 140 or sink 141. Some of the water in hot tank 143 is heated by heat recovered from the heat pump circuit in the shallow basin.

Water from basin 29 having had heat extracted by a heat pump circuit in the basin, described in FIGS. 1-3, is pumped to second tank 153 where the water can be used to flush toilet 155 which abuts the tub 140. Thus the sink and toilet both abut the tub or shower and exist between linear tub sides 162 and the other linear side parallel and spaced apart from side 162 and placed against residential wall 171.

Figure 9:
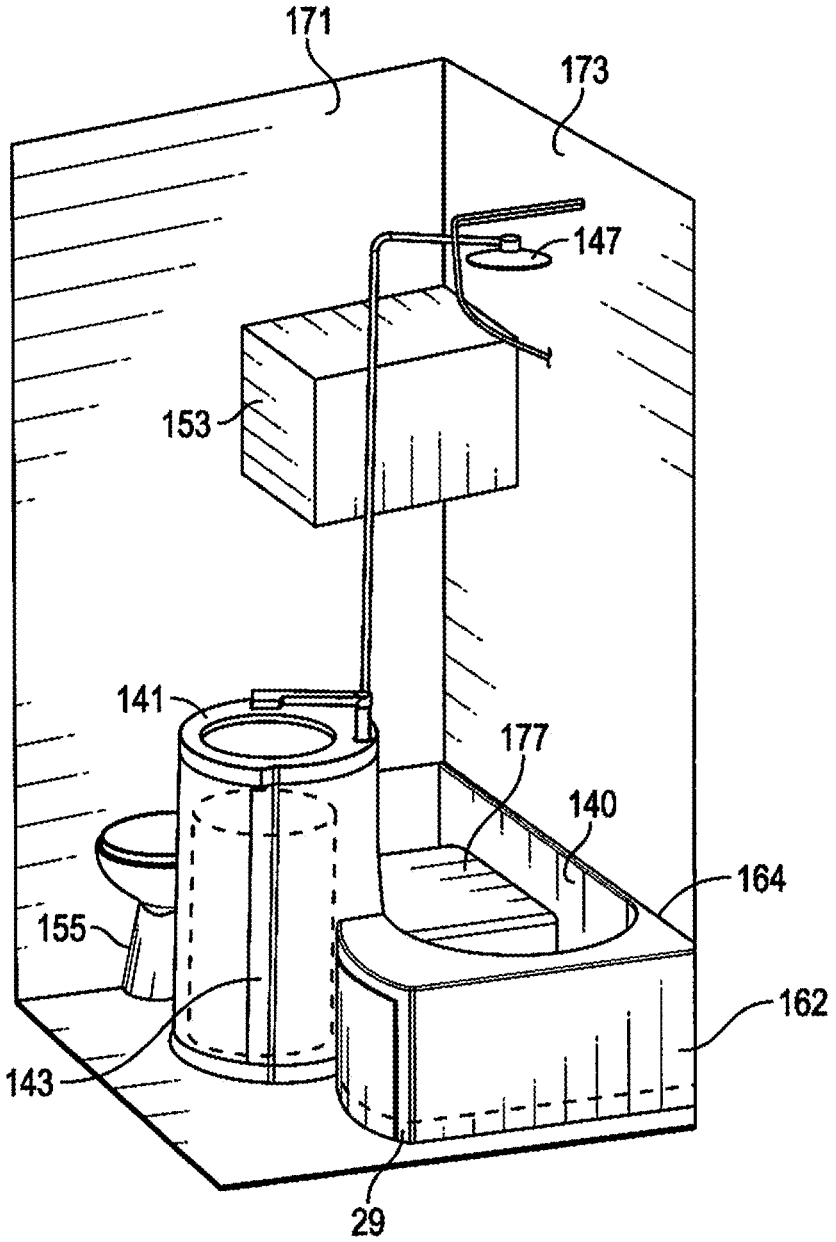
FIG. 9 is an alternate embodiment of the apparatus of FIG. 8 with sink and toilet positions reversed.

In the alternate embodiment of FIG. 9, the positions of sink 141 and toilet 155 are reversed with the toilet abutting the narrow end of the tub. The tub 140 includes a foot rest 177 mentioned above with reference to further embodiment of FIG. 6. The second tank 153 holds water from basin 29 and that has had heat removed and is used to flush toilet 155. The sink, toilet and tub or shower are in a unitary clustered arrangement for placement in small spaces in residential construction.

A table showing operational sequences is below.

Sensors in basic unit of FIGS. 1-6.

Temp of hot tank, temp of sump, low water sensor, high water sensor.

Hot tank has low limit and high limit set.

Solenoid allows supply water flow.

Complete Unit of FIG. 7: Add toilet tank low water limit.

Operational Sequence in Basic Unit of FIGS. 1-6

User sets mixing valve, turns on solenoid, bathes or showers.

Water sensed in sump, compressor turns on.

Sump water temp drops to lower limit, pump turns on.

Sump water temp rises an increment, pump turns off.

Bather turns mixing valve to cold and fill valve off.

Heat cycle continues until water is gone, then pump and compressor turn off.

If hot tank needs more, solenoid opens for set time to start backup cycle.

Normal tank heat cycle proceeds.

Backup cycle continues until hot tank is satisfied.

(Safety) If basin water level too high, solenoid disabled, alarm flashes.

Operational Sequence in Complete Unit of FIG. 7

User sets mixing valve, turns on solenoid, bathes or showers.

Water sensed in sump, compressor turns on.

Sump water temp drops to lower limit, pump turns on.

Sump water temp rises an increment, pump turns off

Bather turns mixing valve to cold.

Heat cycle continues until water is gone, then pump and compressor turn off.

If hot tank needs more, solenoid opens for set time to start backup cycle.

Normal tank heat cycle proceeds.

Backup cycle continues until hot tank is satisfied.

If toilet tank water level low and hot tank satisfied, solenoid opens and pump operates.

(Safety) If basin water level too high, solenoid closes, alarm flashes.

What is claimed is:

1. An energy saving bathroom unit for residential construction comprising:

a. a tub or shower fixture having two or three outwardly facing linear sides joined at extremities, whereby the linear sides of the unit allow for placement of the unit as a bathroom module in residential construction;

b. a shallow basin immediately below the tub or shower in a position receiving bathing water from the tub or shower by gravitational flow;

c. an integral heat pump circuit having a compressor, a condenser heat exchanger associated with a pressurized tank, an evaporator heat exchanger in the basin that captures heat from water in the basin, and an expansion device that restricts flow from the condenser heat exchanger to the evaporator heat exchanger;

d. a sink abutting the tub with a first tank below the sink and plumbed to use pressurized heated water from the pressurized tank; and e. a toilet abutting the tub or shower, the toilet receiving flush water from an atmospheric tank above the toilet, where the atmospheric tank is plumbed to receive drain water pumped from the shallow basin, whereby the linear sides of the unit allow for placement of the unit as a bathroom module in residential construction.

2. The unit of claim 1 wherein the tub is shaped with a narrow end and a wide end.

3. The unit of claim 2 wherein the narrow end of the tub is adjacent to two outwardly facing linear sides of the unit.

4. The unit of claim 2 wherein the wide end of the tub is adjacent to two outwardly facing sides of the unit.

5. The unit of claim 2 wherein the wide end of the tub is deeper than the narrow end of the tub.

6. The unit of claim 2 wherein the toilet is abutting the narrow end of the tub.

7. The unit of claim 2 wherein the tub has a raised near-horizontal foot-rest at the narrow end of the tub.

8. The unit of claim 1 mounted on a structural sheet wherein the structural sheet is part of the subfloor in residential construction.

* * * * *